US011307526B2

(12) United States Patent
Sabo et al.

(10) Patent No.: US 11,307,526 B2
(45) Date of Patent: Apr. 19, 2022

(54) PRINT AGENT APPLICATION ASSEMBLY CLEANING TOOLS

(71) Applicant: HP INDIGO B.V., Amstelveen (NL)

(72) Inventors: David Sabo, San Diego (CA); Barak Rosenstein, Ness Ziona (IL); Ilan Ben-Basat, Ness Ziona (IL); Roman Katz, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 267 days.

(21) Appl. No.: 16/495,321

(22) PCT Filed: Apr. 6, 2017

(86) PCT No.: PCT/US2017/026426

§ 371 (c)(1),
(2) Date: Sep. 18, 2019

(87) PCT Pub. No.: WO2018/186871

PCT Pub. Date: Oct. 11, 2018

(65) Prior Publication Data

US 2021/0325815 A1 Oct. 21, 2021

(51) Int. Cl.
*G03G 21/00* (2006.01)
*G03G 15/10* (2006.01)

(52) U.S. Cl.
CPC ..... *G03G 21/0017* (2013.01); *G03G 21/0011* (2013.01); *G03G 21/0088* (2013.01)

(58) Field of Classification Search
CPC .... G03G 21/0017; G03G 13/11; G03G 15/11; G03G 21/0088; G03G 21/0011; A47L 13/08; A47J 9/00; A47J 9/001
See application file for complete search history.

(56) References Cited

U.S. PATENT DOCUMENTS 2,264,374 A * 12/1941 Henschell ..... A47L 13/08 30/169
3,562,826 A * 2/1971 Vaughn ..... B25F 1/00 7/105
5,956,799 A * 9/1999 Panaccione ..... E04F 21/06 15/236.01
6,360,660 B1 3/2002 Allison
6,493,937 B1 12/2002 Axtell et al.
6,975,822 B2 12/2005 Kunou et al.
7,668,488 B2 2/2010 Guzman et al.
(Continued)

FOREIGN PATENT DOCUMENTS

CN 2374348 4/2000
CN 1304061 7/2001
(Continued)

*Primary Examiner* — Daniel J Colilla

(74) *Attorney, Agent, or Firm* — HP Inc. Patent Department

(57) ABSTRACT

A print agent application assembly cleaning tool is disclosed. The print agent application assembly cleaning tool may include a handle and a flexible blade. The flexible blade may be inserted into a gap between a pair of electrodes of a print agent application assembly. The blade may protrude from a distal end of the handle in a lengthwise direction. The blade may have a width that varies to define a curved profile. The width may reduce and subsequently increase along a length of the blade so as to define a recess in an edge of the blade.

15 Claims, 8 Drawing Sheets

(56) References Cited

U.S. PATENT DOCUMENTS

| | | | | |
|---|---|---|---|---|
| 7,689,140 | B2 | 3/2010 | Takesawa et al. | |
| 8,503,901 | B2 | 8/2013 | Akita et al. | |
| 2007/0110470 | A1* | 5/2007 | Takesawa ..... | G03G 15/0815 399/99 |
| 2009/0320299 | A1* | 12/2009 | Kuhn ..... | B28D 1/183 30/169 |
| 2016/0349668 | A1 | 12/2016 | Pingel et al. | |

FOREIGN PATENT DOCUMENTS

| | | | | |
|---|---|---|---|---|
| CN | 201259612 | | | 6/2009 |
| CN | 201279977 | | | 7/2009 |
| CN | 202214966 | | | 5/2012 |
| CN | 205868877 | | | 1/2017 |
| DE | 202008015032 | | | 4/2009 |
| EP | 1679556 | | | 7/2006 |
| JP | 54136846 | | | 10/1979 |
| JP | 61287759 | | | 12/1986 |
| JP | 264975 | U | * | 5/1990 |
| JP | 2009083341 | A | * | 4/2009 |
| JP | 2015104462 | A | * | 6/2015 |
| RU | 2156697 | | | 9/2000 |
| RU | 2007140522 | | | 5/2009 |
| RU | 2363597 | | | 8/2009 |
| RU | 152960 | | | 6/2015 |

* cited by examiner

PRINT AGENT APPLICATION ASSEMBLY CLEANING TOOLS

BACKGROUND

In the field of printing, liquid electrophotography (LEP) technology may be implemented. LEP printing involves the transfer of electrically-charged print agent via a series of rollers to a substrate.

BRIEF DESCRIPTION OF DRAWINGS

Examples will now be described, by way of non-limiting example, with reference to the accompanying drawings, in which.

DETAILED DESCRIPTION

In a liquid electrophotography (LEP) printing system, print agent, such as printing fluid (e.g. ink), is used in a print agent application assembly, which may be referred to as a binary ink developer (BID). In some examples, each print agent application assembly uses print agent of a particular colour, so an LEP printing system may include, for example, seven print agent application assemblies. Print agent from a print agent application assembly is selectively transferred, for example from a roller of the print agent application assembly (referred to herein as a developer roller) in a layer of substantially uniform thickness to a photoconductive surface, which may comprise a photo imaging plate (PIP). The selective transfer of print agent is achieved through the use of electrically-charged print agent. In some examples, substantially the entire photoconductive surface is charged, then areas representing an image to be printed are discharged. Print agent is transferred to those portions of the photoconductive surface that have been discharged. The photoconductive surface transfers the print agent to a printing blanket, which subsequently transfers the print agent onto a printable substrate, such as paper. The discharged portions of the photoconductive surface represent the portion or portions of a pattern or image in which print agent from the print agent application assembly is to be applied to the substrate. Print agent that is not transferred from the developer roller to the photoconductive surface (i.e. in those areas where the photoconductive surface remains charged) remains on the developer roller, and is removed from the developer roller by components within the print agent application assembly, as discussed below.

Figure 1:
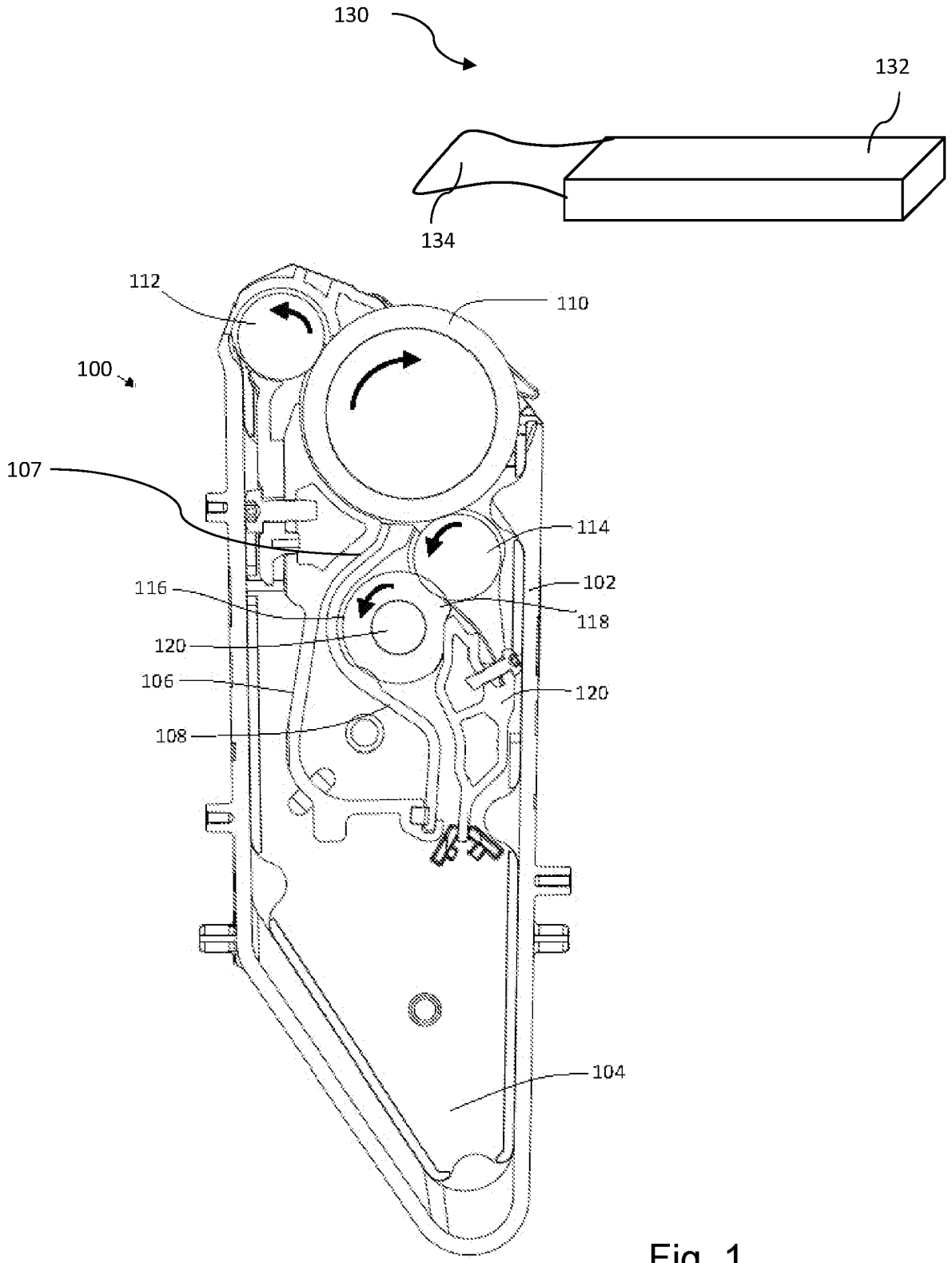
FIG. 1 is a sectional representation of an example of a print agent application assembly.

FIG. 1 is a sectional representation of an example print agent application assembly 100. Some components of the print agent application assembly 100 are not shown in FIG. 1 for clarity.

The print agent application assembly 100 includes a housing 102 within which other components are at least substantially disposed. A print agent tray 104 is formed near to the bottom of the housing 102 to catch unused print agent, as discussed below. The print agent tray 104 may be referred to as an ink capture tray. The assembly 100 includes a first electrode 106 and a second electrode 108. Print agent may travel from a print agent reservoir (not shown), which may be located outside the print agent application assembly 100, between the first and second electrodes 106, 108, towards a developer roller 110. The developer roller 110 rotates in a direction shown in FIG. 1.

The assembly 100 further includes a squeegee roller 112, which rotates in a direction opposite to the direction of rotation of the developer roller 110, as shown in FIG. 1. The squeegee roller 112 is urged towards the developer roller 110 so as to compact and remove excess liquid from the print agent that coats the developer roller. The squeegee roller causes the print agent on the developer roller to be of substantially uniform thickness. After being compacted by the squeegee roller 112, print agent on the developer roller 110 is selectively transferred to a selectively charged photo imaging plate (not shown) and, subsequently, to a printing blanket for transfer onto a substrate, as described above.

Print agent that is not transferred from the developer roller 110 to the photo imaging plate is referred to as unused print agent. A cleaner roller 114 is disposed within the assembly 100 adjacent to the developer roller 110, and rotates in a direction opposite to the direction of rotation of the developer roller 110, as shown in FIG. 1. The cleaner roller 114 is electrically charged and attracts electrically-charged print agent, thereby cleaning unused print agent from the developer roller 110.

The assembly 110 also includes a sponge roller 116, which includes an absorbent material 118, such as a sponge, mounted around a core 120. The sponge roller 116 rotates in the same direction as the cleaner roller, as shown in FIG. 1. The sponge roller 116 is mounted adjacent to the cleaner roller, such that, as the sponge roller rotates, the absorbent material 118 absorbs the unused print agent from the surface of the cleaner roller. The absorbent material 118 of the sponge roller has a number of open cells, or pores, for absorbing liquid, such as the unused print agent. In some examples, the absorbent material 118 may be open-cell polyurethane foam.

A wiper assembly 120 is also mounted within the assembly 100. The wiper assembly 120 (or components thereof) may serve to wipe, or clean, portions of at least one of the rollers in the assembly 100. As such, the wiper assembly 120 may be referred to as a roller cleaning assembly.

The assembly 100 may further comprise a cleaning tool 130 comprising a handle 132 and a flexible blade 134. The flexible blade 134 may be inserted into a gap 107 between the electrodes 106, 108, e.g. to clean between the electrodes. As depicted, the blade 134 may have a width that varies to define a curved profile.

Figure 2:
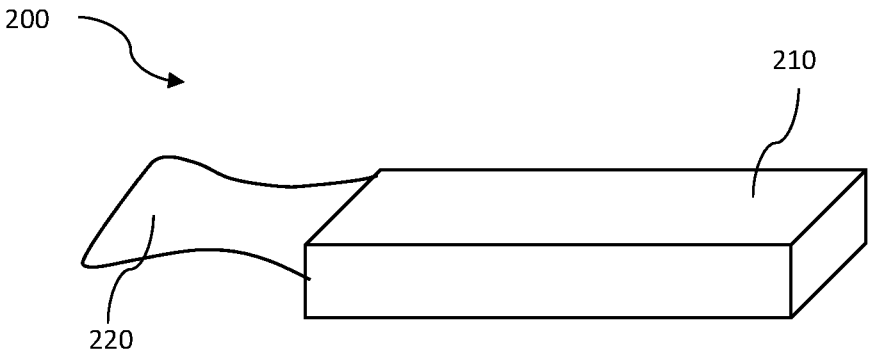
FIG. 2 is a schematic illustration of an example of a print agent application assembly cleaning tool.
Figure 3:
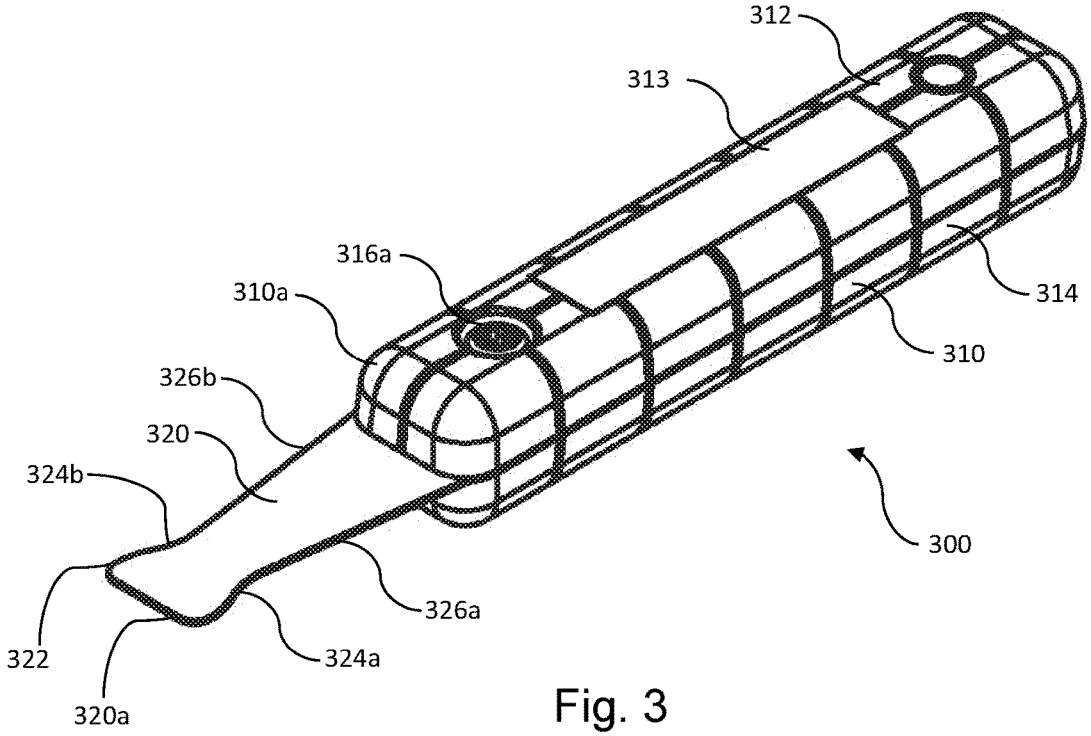
FIG. 3 is a perspective view of an example of a print agent application assembly cleaning tool.
Figure 4:
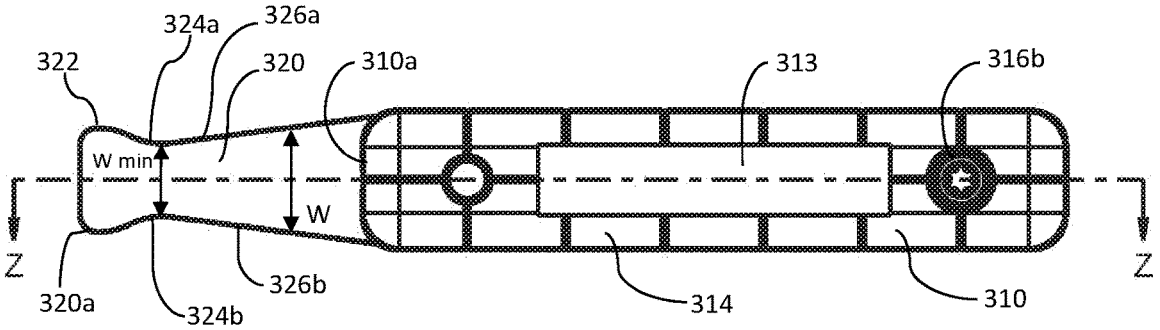
FIG. 4 is a plan view of an example of a print agent application assembly cleaning tool.

FIG. 2 is a schematic illustration of an example of a print agent application assembly cleaning tool 200 that may be used to clean between the electrodes 106, 108 of the print agent application assembly 100. The print agent application assembly cleaning tool 200 may comprise a handle 210 and a flexible blade 220. The flexible blade 220 may be inserted into the gap 107 between the electrodes of a print agent application assembly. At least a portion of the blade 220 may protrude from a distal end of the handle 210 in a lengthwise direction. The blade 220 may have a width that varies to define a curved profile. The blade width may reduce and subsequently increase along a length of the blade so as to define a recess, e.g. indentation, in an edge of the blade.

FIGS. 3 to 6 depict a further example of a print agent application assembly cleaning tool 300. The print agent application assembly cleaning tool 300 may comprise a handle 310 and a flexible blade 320. The flexible blade 320 may be inserted into the gap 107 between the electrodes 106, 108 of a print agent application assembly 100, such as that described above. The blade 320 may protrude from a distal end 310*a* of the handle 310 in a lengthwise direction. The blade 320 may be elongate, e.g. with a length that is greater than its width. The handle 310 may also be elongate, e.g. with a length that is greater than its width.

The blade 320 may have a width W that varies in the lengthwise direction of the blade to define a curved profile 322. The blade width W may reduce and subsequently increase along a length of the blade 320 so as to define a first recess 324*a*, e.g. indentation, in a first lengthwise edge 326*a* of the blade and a second recess 324*b*, e.g. indentation, in a second lengthwise edge 326*b* of the blade. In an alternative example, one of the edges 326*a*, 326*b* may be straight, while another may comprise a recess. The minimum width $W_{min}$ of the blade 320 may occur closer to a distal end 320*a* of the blade than the distal end 310*a* of the handle 310.

The width W of the blade 320 may vary in a gradual manner, e.g. without sharp corners. For example, the curved profile may have a radius of curvature (e.g. in a plane in which the blade resides) at points along the edges 326*a*, 326*b* and distal end 320*a* that may be greater than or equal to approximately 0.5 mm. In a particular example, the radius of curvature of points along the edges 326*a*, 326*b* and distal end 320*a* may be approximately 2 mm or more.

Figure 5:
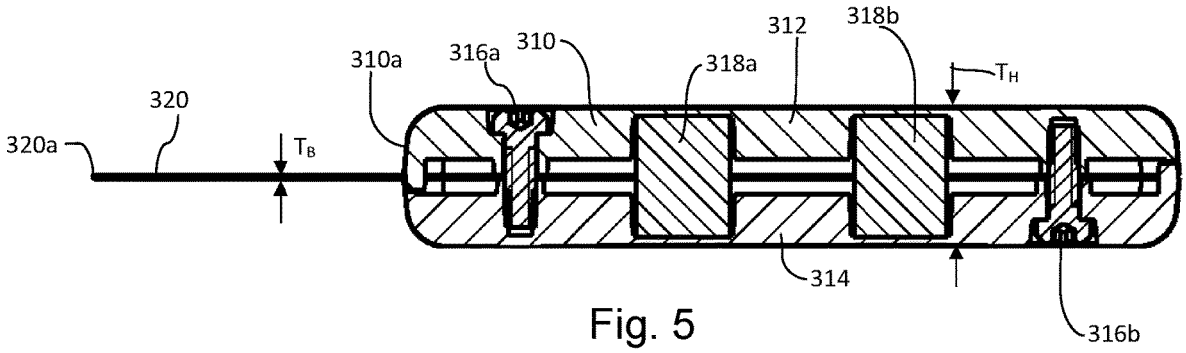
FIG. 5 is a side sectional view of an example of a print agent application assembly cleaning tool and corresponds to section Z-Z depicted in FIG. 4.
Figure 6:
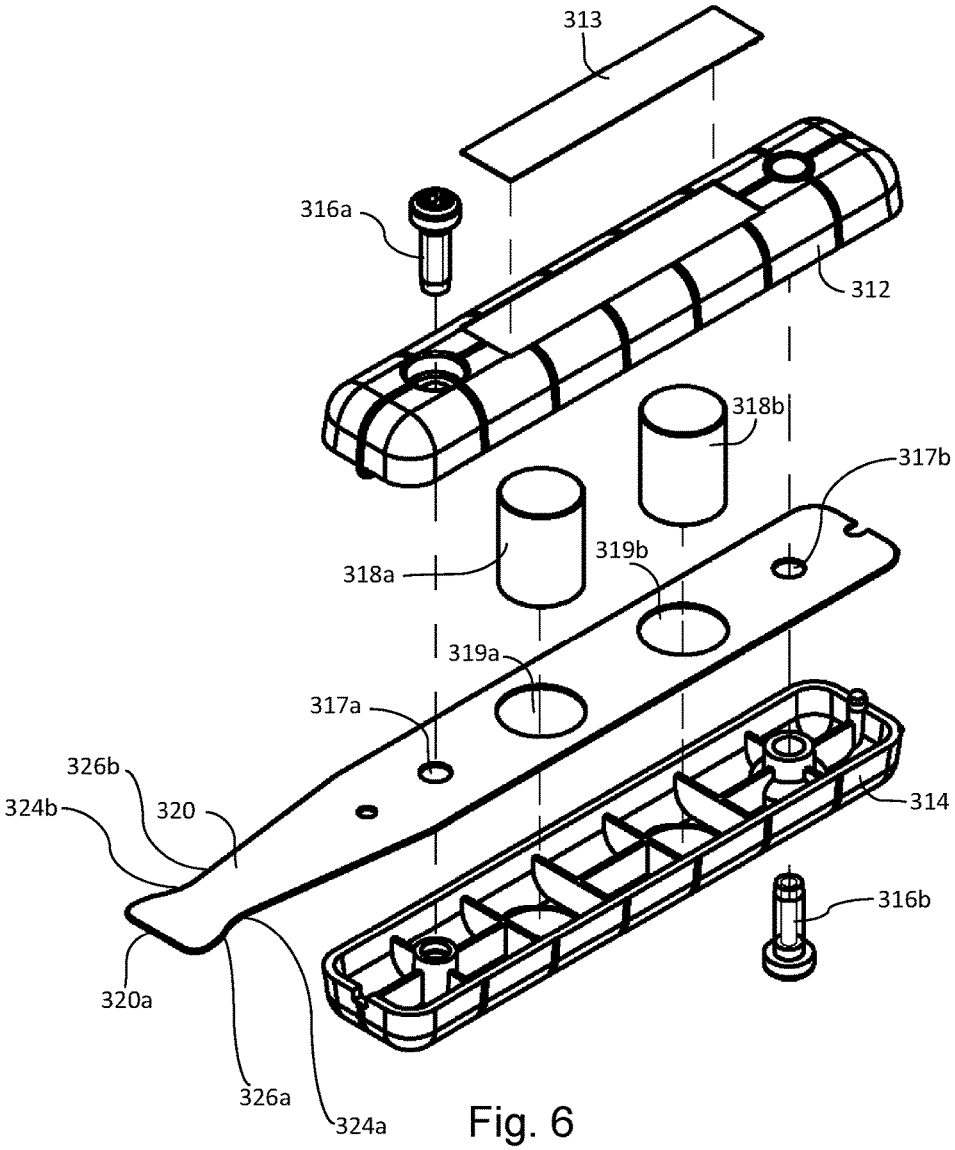
FIG. 6 is an exploded view of an example of a print agent application assembly cleaning tool.

As shown in FIGS. 5 and 6, in an example of the print agent application assembly cleaning tool 300, the blade 320 may extend inside and substantially along the length of the handle 310. The blade 320 may be held in place between two opposing parts 312, 314 of the handle. The two opposing parts 312, 314 may be attached together, e.g. by virtue of at least one fastener, such as screws 316*a*, 316*b*. In the particular example shown there are two screws 316*a*, 316*b*. The screws 316*a*, 316*b* may be inserted from opposite sides of the handle 310, although in alternative arrangements the screws 316*a*, 316*b* may be inserted from the same side. The screws 316*a*, 316*b* may extend through respective apertures 317*a*, 317*b* in the blade 320. Accordingly, the screws 316*a*, 316*b* may also hold the blade 320 in place with respect to the handle 310. In an alternative example, the opposing parts 312, 314 may be attached together by virtue of a snap-fit.

Referring still to FIGS. 5 and 6, in an example of the print agent application assembly cleaning tool 300, the handle 310 may comprise at least one magnet to selectively attach the cleaning tool to a surface. In the particular example shown, the handle 310 may comprise a pair of magnets 318*a*, 318*b*. The at least one magnet 318*a*, 318*b* may extend substantially across a thickness TH of the handle 310 so that the cleaning tool may attach to a surface from either side of the handle. If the blade extends inside the handle 310, the at least one magnet 318*a*, 318*b* may pass through a corresponding aperture 319*a*, 319*b* in the blade. The apertures 319*a*, 319*b* may locate the magnets 318*a*, 318*b* within the handle 310.

A tag 313 may be affixed to the handle 310. A tag 313 may be provided on both sides of the handle 310 so that a tag is visible regardless of which side of the handle is attached to a surface.

The blade 320 may be made from a plastics material, such as Polyoxymethylene, which may also be referred to as Acetal or Delrin®. The blade may have a thickness TB of approximately 0.5 mm. At least one of the blade thickness and blade material may be selected so that the blade may be flexible enough to follow the gap 107 between the electrodes 106, 108.

Figure 7:
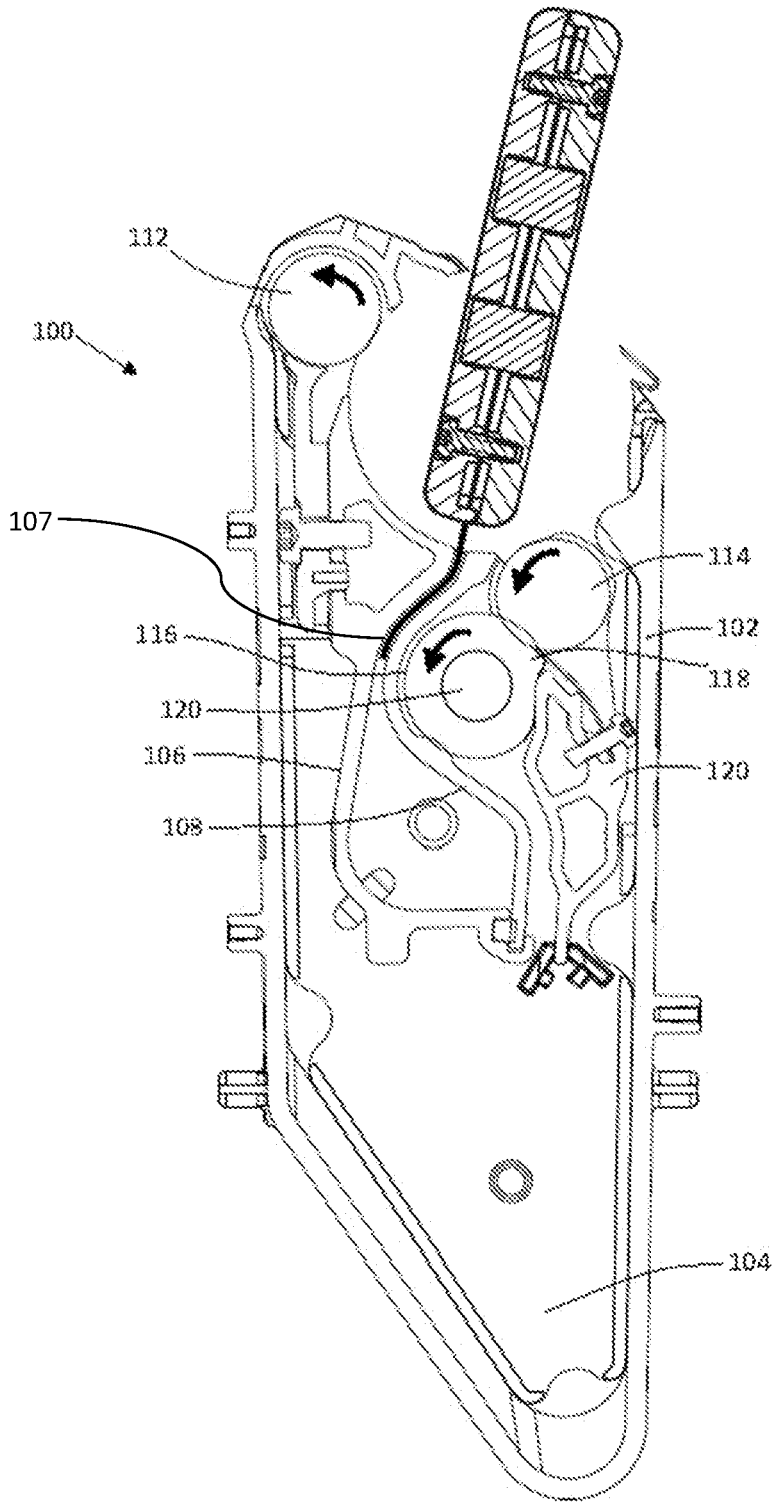
FIG. 7 is a sectional representation of an example of a print agent application assembly with an example of a print agent application assembly cleaning tool.
Figure 8:
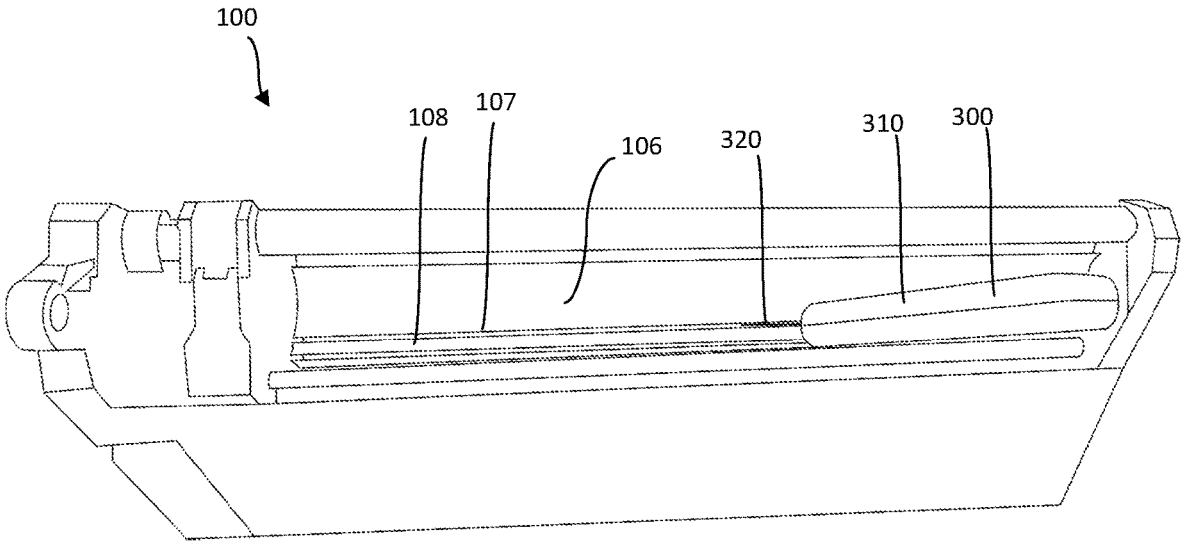
FIG. 8 is a perspective representation of an example of a print agent application assembly with an example of a print agent application assembly cleaning tool.

FIGS. 7 and 8 depict the above discussed example of the print agent application assembly cleaning tool 300 inserted into the gap 107 between the electrodes 106, 108 of the print agent application assembly 100, such as that described above. The developer roller 110 may be removed to permit access to the gap 107. The flexibility of the blade 320 may permit the blade to follow a curved path of the gap between the electrodes 106, 108. Furthermore, the recesses 324*a*, 324*b* in the blade edges 326*a*, 326*b* may permit the blade to hook unwanted matter from between the gap so that the unwanted matter may be extracted as the blade is withdrawn from the gap. The unwanted matter may be print agent particles, e.g. particles formed from and/or suspended in the print agent. The blade 320 may be moved laterally along the gap 107, e.g. from one lateral end of the gap to another so as to collect the unwanted matter. The curved profile of the blade 320 may assist in preventing damage to seals, which may be provided at the lateral ends of the gap 107.

Figure 9:
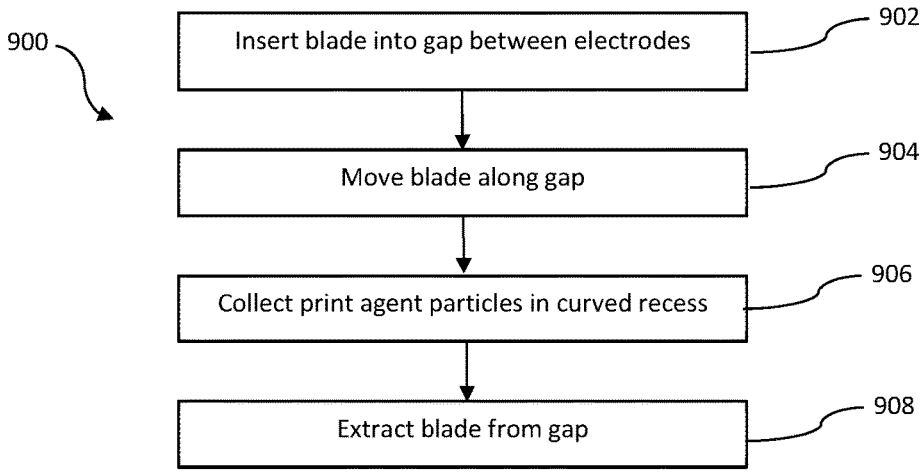
FIG. 9 is a flowchart of an example of a method of cleaning a print agent application assembly.

Referring now to FIG. 9, a method 900 is disclosed. FIG. 9 is a flowchart of an example of a method of using a cleaning tool, such as the print agent application assembly cleaning tool 200, 300 discussed above, to clean a print agent application assembly, such as the assembly 100 discussed above.

The method 900 may comprise, at block 902, inserting a flexible blade of the cleaning tool into a gap between a pair of electrodes of a print agent application assembly. At block 904, the method may further comprise moving the blade along the gap. At block 906, the method may comprise collecting unwanted matter, e.g. print agent particles, in a curved recess formed in an edge of the blade. At block 908, the method may comprise extracting the blade from the gap.

The method may further comprise removing the print agent application assembly from a print apparatus. The print agent application assembly may be placed on a stand. A developer roller, such as developer roller 110 described above, may be removed from the print agent application assembly to expose the pair of electrodes. Unwanted matter may then be removed from between the electrodes.

Once the electrodes have been cleaned, the developer roller may be returned to the print agent application assembly. The print agent application assembly may then be returned to the print apparatus. Whilst not in use, the cleaning tool may be attached to a surface by virtue of at least one magnet.

Figure 10:
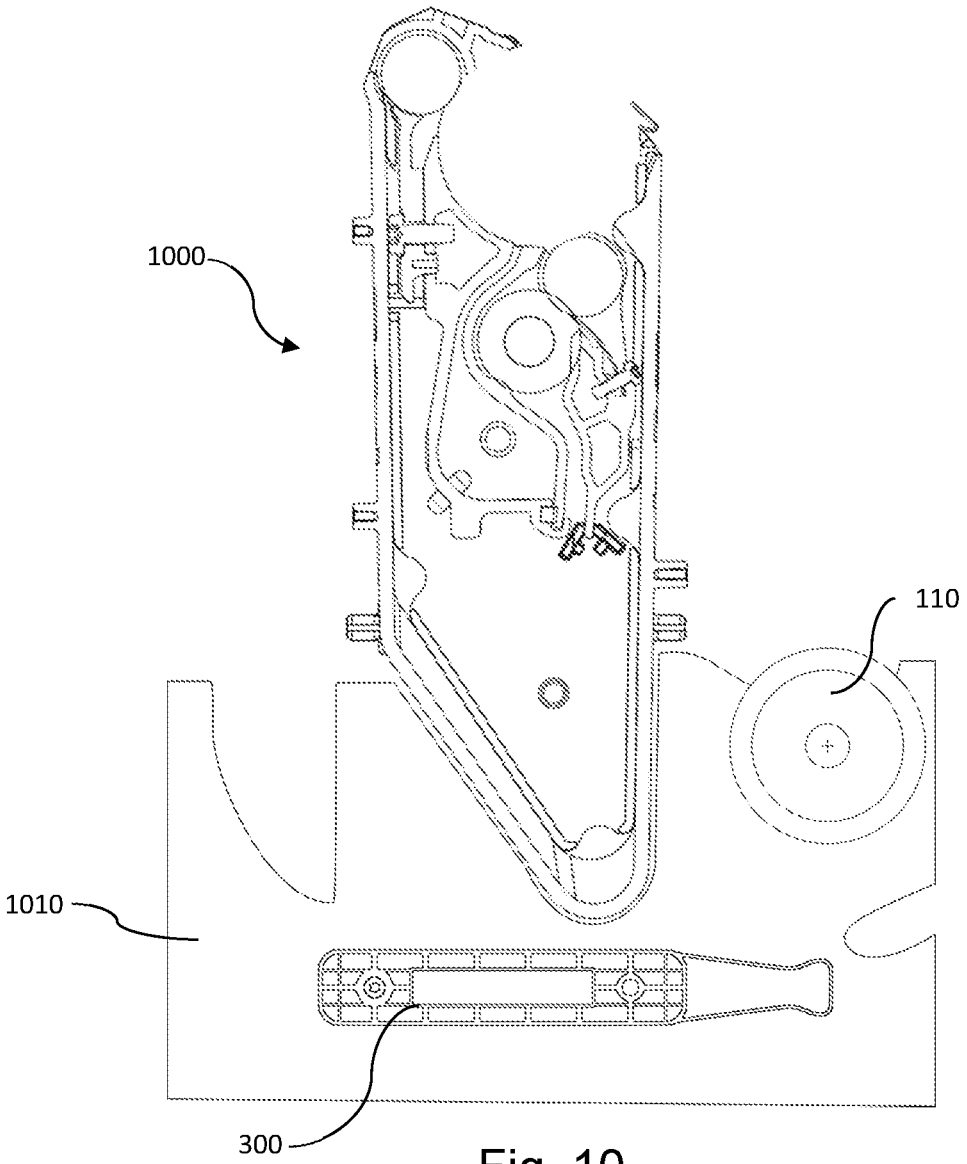
FIG. 10 is a sectional side view of an example of a print agent application assembly.

FIG. 10 depicts an example of an assembly 1000 comprising a print agent application assembly, such as the above described print agent application assembly 100, and a cleaning tool, such as cleaning tool 300. The print agent application assembly 100 may be removed from a print apparatus in which it operates. As depicted, the print agent application assembly 100 may rest on a stand 1010 when removed from the print apparatus. The developer roller 110 may be removed from the remainder of the print agent application assembly 100 and may also rest on the stand 1010. The cleaning tool 300 may be attached to the stand, e.g. by virtue of the magnets 318*a*, 318*b*. The cleaning tool 300 may thus be conveniently positioned for a user to detach from the stand and use the tool to clean electrodes of the print agent application assembly 100 whilst the print agent application assembly 100 rests on the stand. In other examples, a print agent application assembly may have a different configuration from the example shown.

Figure 11:
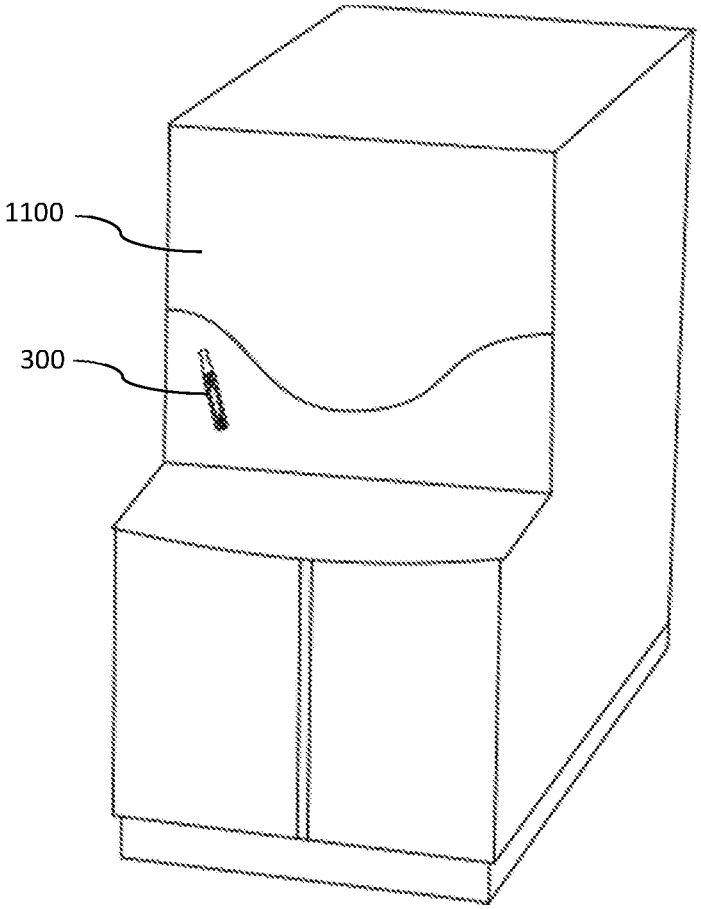
FIG. 11 is a perspective view of a print apparatus.

FIG. 11 depicts an example of a print apparatus 1100, which may comprise at least one print agent application assembly, such as those described above, e.g. with one for each colour. A cleaning tool, such as the cleaning tools 300 described above, may be attached to a surface of the print apparatus 1100, e.g. by virtue of the magnets 318*a*, 318*b*. The cleaning tool 300 may thus be conveniently located for a user to clean any of the print agent application assemblies within the print apparatus 1100. In some examples, the print apparatus 1100 may comprise a liquid electrophotography (LEP) print apparatus.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A print agent application assembly cleaning tool comprising:

a handle; and a flexible blade configured to be inserted into a gap between a pair of electrodes of a print agent application assembly, the blade protruding from a distal end of the handle in a lengthwise direction, wherein the blade has a width that varies to define a curved profile and that reduces and subsequently increases along a length of the blade so as to define a recess in an edge of the blade; and wherein the recess is configured to collect unwanted matter from the pair of electrodes.

2. The print agent application assembly cleaning tool of claim 1, wherein the width reduces and subsequently increases along the length of the blade so as to define a recess in both edges of the blade.

3. The print agent application assembly cleaning tool of claim 1, wherein the width of the blade varies to define the curved profile in which a local radius of curvature is greater than or equal to approximately 0.5 mm.

4. The print agent application assembly cleaning tool of claim 1, wherein the blade extends inside and substantially along the length of the handle.

5. The print agent application assembly cleaning tool of claim 4, wherein the blade is held in place between two opposing parts of the handle.

6. The print agent application assembly cleaning tool of claim 1, wherein the minimum width of the blade occurs closer to a distal end of the blade than the handle.

7. The print agent application assembly cleaning tool of claim 1, wherein the handle comprises at least one magnet to selectively attach the cleaning tool to a surface.

8. The print agent application assembly cleaning tool of claim 7, wherein the blade extends inside the handle and the at least one magnet passes through an aperture in the blade.

9. The print agent application assembly cleaning tool of claim 1, wherein the blade is made from Polyoxymethylene.

10. The print agent application assembly cleaning tool of claim 1, wherein the blade is approximately 0.5 mm thick.

11. A method comprising:

inserting a flexible blade of a cleaning tool into a gap between a pair of electrodes of a print agent application assembly;

moving the blade along the gap;

collecting unwanted matter in a curved recess formed in an edge of the blade; and extracting the cleaning tool from the gap.

12. The method of claim 11 comprising:

removing the print agent application assembly from a print apparatus; and mounting the print agent application assembly in the print apparatus.

13. The method of claim 11 comprising:

removing a developer roller from the print agent application assembly to expose the pair of electrodes; and mounting a developer roller to the print agent application assembly.

14. The method of claim 11, comprising:

attaching the cleaning tool to a surface by virtue of at least one magnet.

15. An assembly comprising:

a print agent application assembly comprising a pair of electrodes with a gap therebetween for supplying print agent to a developer roller; and a cleaning tool comprising a handle and a flexible blade for insertion into the gap to remove print agent from the gap, wherein the handle comprises at least one magnet to selectively attach the cleaning tool to a surface.

* * * * *